US011313574B2

(12) United States Patent
Xing et al.

(10) Patent No.: US 11,313,574 B2
(45) Date of Patent: Apr. 26, 2022

(54) DISPLAY ASSEMBLY AND WINDOW AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Zhigang Xing, Foshan (CN); Yu Liu, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 0 days.

(21) Appl. No.: 16/914,814

(22) Filed: Jun. 29, 2020

(65) Prior Publication Data

US 2021/0199332 A1 Jul. 1, 2021

Related U.S. Application Data

(63) Continuation of application No. PCT/CN2020/077632, filed on Mar. 3, 2020.

(30) Foreign Application Priority Data

Dec. 31, 2019 (CN) ..... 201911425273.X
Dec. 31, 2019 (CN) ..... 201911425731.X
(Continued)

(51) Int. Cl.
*F24F 11/52* (2018.01)
*F24F 1/027* (2019.01)
(Continued)

(52) U.S. Cl.
CPC ..... *F24F 11/52* (2018.01); *F24F 1/027* (2013.01); *F24F 11/56* (2018.01); *F24F 11/89* (2018.01);
(Continued)

(58) Field of Classification Search
CPC .. F24F 11/52; F24F 1/027; F24F 11/89; F24F 13/22; F24F 11/56; F24F 2013/221
See application file for complete search history.

(56) References Cited

U.S. PATENT DOCUMENTS

2012/0095605 A1* 4/2012 Tran ..... G05D 23/1923 700/285
2017/0060149 A1* 3/2017 Giustina ..... F24F 11/52
(Continued)

FOREIGN PATENT DOCUMENTS

CN 208059207 U 11/2018
CN 109140699 A 1/2019
(Continued)

OTHER PUBLICATIONS

World Intellectual Property Organization (WIPO) International Search Report and Written Opinion for PCT/CN2020/077632 dated Jul. 1, 2020 16 Pages.

*Primary Examiner* — Ziaul Karim
(74) *Attorney, Agent, or Firm* — Anova Law Group PLLC

(57) ABSTRACT

A display assembly includes a display box including a base plate having a display portion and a key via hole, an electric control board provided in the display box, and a flexible isolation pad provided in the display box. The flexible isolation pad is located between the base plate and the electric control board, and is configured to isolate the base plate from the electric control board. The display assembly further includes a control key movably provided in the key via hole. The control key is configured to abut against the
(Continued)

flexible isolation pad, and to interact with the electric control board through the flexible isolation pad.

19 Claims, 15 Drawing Sheets

(30) Foreign Application Priority Data

Dec. 31, 2019 (CN) ..... 201922496597.4
Dec. 31, 2019 (CN) ..... 201922499078.3

(51) Int. Cl.
*F24F 11/89* (2018.01)
*F24F 13/22* (2006.01)
*F24F 11/56* (2018.01)

(52) U.S. Cl.
CPC ..... *F24F 13/22* (2013.01); *F24F 2013/221* (2013.01)

(56) References Cited

U.S. PATENT DOCUMENTS

2017/0113513 A1* 4/2017 Yanatsubo ..... B60H 1/00985
2018/0035650 A1* 2/2018 Ellis ..... B33Y 80/00
2019/0059626 A1* 2/2019 Ellis ..... G09F 7/18
2020/0400326 A1* 12/2020 Bailey ..... F24F 11/58

FOREIGN PATENT DOCUMENTS

CN 209857235 U 12/2019
KR 20110034107 A 4/2011
KR 101636993 B1 7/2016

* cited by examiner

DISPLAY ASSEMBLY AND WINDOW AIR CONDITIONER

CROSS-REFERENCE TO RELATED APPLICATIONS

This application is a continuation of International Application No. PCT/CN2020/077632, filed on Mar. 3, 2020, which claims priority to Chinese Application Nos. 201911425273.X, 201922496597.4, 201911425731.X, and 201922499078.3, all filed on Dec. 31, 2019, the entire contents of which are incorporated herein by reference.

TECHNICAL FIELD

The present disclosure relates to the technical field of air conditioners, in particular to a display assembly and a window air conditioner.

BACKGROUND

In the related art, the display assembly of the window air conditioner includes a display box and an electric control board installed in the display box. The electric control board has a key switch. The display assembly is usually provided inside a face frame and near an air outlet. A key via hole is provided at a front surface of the display box, and a key mounting hole is provided at the face frame, and the control key is sequentially passed through the key via hole and the key mounting hole to control the key switch.

As such, the cold air from the air outlet easily enters the display box from the key mounting hole and the key via hole, thereby easily forming condensate on the inner wall surface of the electric control box or the electric control board, which may cause the display assembly to malfunction.

SUMMARY

The main objective of the present disclosure is to provide a display assembly and a window air conditioner, aiming to solve the technical problem that the condensate formed on the surface of the face frame easily enters the display box in the related art.

In order to achieve the above objective, the present disclosure provides a display assembly, including:

a display box comprising a base plate having a display portion and a key via hole;

an electric control board provided in the display box;

a flexible isolation pad provided in the display box, the flexible isolation pad being located between the base plate and the electric control board, and configured to isolate the base plate from the electric control board; and a control key movably provided in the key via hole, the control key being configured to abut against the flexible isolation pad, and configured to interact with the electric control board through the flexible isolation pad.

In some embodiments, the flexible isolation pad is a silicone pad or a soft rubber pad.

In some embodiments, the flexible isolation pad is attached to a periphery of the key via hole.

In some embodiments, the flexible isolation pad is at least partially attached to a periphery of the electric control board.

In some embodiments, the control key is integrated with the flexible isolation pad.

In some embodiments, the flexible isolation pad comprises an annular movable portion outside the control key, and a thickness of the annular movable portion is smaller than a thickness of the flexible isolation pad outside the annular movable portion.

In some embodiments, a side of the flexible isolation pad away from the base plate is provided with a first sink groove corresponding to the control key; and/or a side of the flexible isolation pad towards the base plate is provided with a second sink groove, the control key being provided at a bottom of the second sink groove.

In some embodiments, a key groove is provided at the bottom of the first sink groove, a button of a key switch on the electric control board being provided in the key groove.

In some embodiments, an annular groove is provided at the bottom of the key groove, the annular groove being provided at a periphery of the control key.

In some embodiments, the first sink grooves are spaced apart from each other in the length direction of the display box, and some adjacent first sink grooves communicate with each other.

In some embodiments, an indicator light protrudes from the electric control board, a connection hole is provided at the flexible isolation pad, a connection protrusion protrudes from a side of the base plate towards the flexible isolation pad, the display portion comprises a lamp mounting hole provided at the connection protrusion, the lamp mounting hole is configured to penetrate the base plate, the connection protrusion is inserted into the connection hole, and the indicator light is provided in the lamp mounting hole.

In some embodiments, a digital display protrusion protrudes from a side of the base plate towards the flexible isolation pad, the display portion comprises a digital display through hole provided at the digital display protrusion, the flexible isolation pad is provided with an avoiding through hole, and the digital display protrusion is provided in the avoiding through hole.

In some embodiments, an alarm protrudes from the electrical control board, a first avoiding groove is provided at a side of the flexible isolation pad away from the base plate corresponding to the alarm, and the alarm is provided in the first avoiding groove; and/or a remote control receiver protrudes from the electric control board, and a second avoiding groove is provided at a side of the flexible isolation pad away from the base plate corresponding to the remote control receiver, and the remote control receiver is provided in the second avoiding groove.

In some embodiments, the electric control board is connected with the base plate through a screw lock structure.

In some embodiments, a side of the base plate towards the flexible isolation pad is convexly provided with a screw hole pillar, the electrical control board is provided with a connection via hole, the flexible isolation pad is provided with a connection avoiding hole, and the screw hole pillar passes through the connection avoiding hole and is screwed with the connection via hole; and/or a positioning pillar protrudes from a side of the base plate towards the flexible isolation pad, a positioning hole is provided at the electric control board, the flexible isolation pad is provided with a positioning avoiding hole, and the positioning pillar passes through the positioning avoiding hole and is inserted into the positioning hole.

In some embodiments, the display box further comprises a thermal-insulation cover and a surrounding plate provided at a periphery of the base plate, an end of the surrounding plate away from the base plate comprising an opening covered by the thermal-insulation cover.

In some embodiments, the thermal-insulation cover is detachably provided at the opening, and is configured to open or cover the opening.

In some embodiments, the thermal-insulation cover is connected with the display box through a clamping structure, and is detachably provided at the opening through the clamping structure.

In some embodiments, elastic limiters spaced apart from each other protrude from a periphery of the opening, and the thermal-insulation cover is clamped between the elastic limiters.

In some embodiments, one of the elastic limiters comprises an elastic pressing plate, a side surface of the elastic pressing plate towards the thermal-insulation cover comprising a pressing surface inclined towards an inner side of the opening, and a side surface of the thermal-insulation cover away from the electric control board being provided with a limiting surface cooperated with the pressing surface.

In some embodiments, a side of the thermal-insulation cover away from the electric control board is provided with a first limiting groove, the elastic pressing plate is provided in the first limiting groove, and the limiting surface is provided at the bottom of the first limiting groove; and/or, the display box includes a base plate disposed opposite to the opening and an upper plate provided at an upper edge of the base plate, the elastic pressing plate is provided at the side edge of the opening of the upper plate, and the elastic pressing plate is spaced apart from each other in the length direction of the upper plate.

In some embodiments, one of the elastic limiters comprises an elastic pressing buckle, a side of the elastic pressing buckle towards the thermal-insulation cover comprising a clamping protrusion, and the clamping protrusion being clamped on a side of the thermal-insulation cover away from the electric control board.

In some embodiments, a side of the thermal-insulation cover away from the electric control board is provided with a second limiting groove, the clamping protrusion being clamped on a bottom of the second limiting groove; and/or the display box includes a base plate disposed opposite to the opening and a lower plate provided at a lower edge of the base plate, the elastic pressing plate is provided at the side edge of the opening of the lower plate, and the elastic pressing plate is spaced apart from each other in the length direction of the lower plate.

In some embodiments, the thermal-insulation cover is provided in the opening, and the periphery of the thermal-insulation cover is provided with an anti-sinking protrusion, and the anti-sinking protrusion abuts on a periphery of the opening.

In some embodiments, the anti-sinking protrusion includes a first anti-sinking protrusion provided at the upper edge of the thermal-insulation cover and a second anti-sinking protrusion provided at the lower edge of the thermal-insulation cover, the first anti-sinking protrusion abuts against the side edge of the opening of the upper plate of the display box, and the second anti-sinking protrusion abuts against the side edge of the opening of the lower plate of the display box.

In some embodiments, the display box is provided with a cable opening communicating with the receiving cavity, and the cable opening includes a cable notch communicating with the opening, the side wall of the cable opening protrudes from the display box in a direction away from the display box, the periphery of the thermal-insulation cover is convexly provided with a crimping protrusion, and the crimping protrusion is provided at the cable notch.

In some embodiments, the thermal-insulation cover is a foam piece.

The present disclosure further provides a window air conditioner, including:

a housing including a face frame; and a display assembly as described above, the display assembly being provided in the housing and being provided at the face frame, and the base plate being provided at the face frame.

In some embodiment, the display box is detachably mounted at the face frame.

In some embodiments, the display box is detachably mounted at the face frame through a clamping structure and/or a screw lock structure.

In some embodiments, the face frame includes a display panel, an air outlet is provided above the display panel; a connection plate provided at a lower edge of the display panel and extending inwards, the display assembly being provided above the connection plate, and the display box being connected to the connection plate and/or the display panel; and an air inlet panel provided at an inner edge of the connection plate and extending downwards, an air inlet being provided at the air inlet panel.

In some embodiments, the surrounding plate of the display box includes an upper plate, a left plate, a lower plate and a right plate connected in sequence;

the upper side of the upper plate is provided with a first locking protrusion, the inner side of the display panel is protruded with a first elastic buckle, the first elastic buckle is provided above the display box, and the first elastic buckle is connected to the first buckle; and/or a first blocking protrusion is provided at the lower side of the lower plate, and a second blocking protrusion is provided at the upper side of the connection plate, the first blocking protrusion is provided at a side of the second blocking protrusion towards the display panel, and the first blocking protrusion is in contact with the second blocking protrusion; and/or the right side of the right plate is provided with a second locking protrusion, and the inner side surface of the display panel is protruded with a second elastic buckle, the second elastic buckle is disposed on the right side of the display box, and the second elastic buckle is clamped with the second locking protrusion; and/or the left plate is convexly provided with a screw connection portion to the left, and the screw connection portion is connected to the display panel through a screw lock structure.

In some embodiments, the housing is provided with a partition groove which divides the window air conditioner into an indoor unit and an outdoor unit, and the partition groove is configured for the shielding member provided at the window to extend.

In some embodiments, the window air conditioner further includes a mounting base and a sealing member, the mounting base is movably mounted on the partition groove, the sealing member is inserted and connected to the mounting base, the sealing member is fixed in an interference fit with the mounting base by deformation, and the sealing member is driven by the mounting base to switch between the storage state and the working state;

in the storage state, the sealing member is stored in the partition groove;

in the working state, the sealing member extends laterally from the partition groove, and is suitable for abutting on the side wall of the shielding member and/or the window.

In the technical solutions of the present disclosure, a flexible isolation pad is provided between the base plate and the electric control board. On the one hand, the flexible isolation pad may isolate the cold air entering the display box from the key mounting hole and the key via hole to prevent the condensate from forming on the electronic control board, and may form two layers of isolation protection for the base plate and the flexible isolation pad, which can improve the protection effect on the electronic control board to prevent the failure of the electronic control board and the display assembly, thereby effectively improving the use reliability of the display assembly and the window air conditioner. On the other hand, due to the flexibility of the flexible isolation pad, the flexible isolation pad may be deformed so as not to affect the effect of the control key on the key switch on the electric control board.

BRIEF DESCRIPTION OF THE DRAWINGS

In order to more clearly illustrate the embodiments of the present disclosure, the drawings used in the embodiments will be briefly described below. Obviously, the drawings in the following description are only some embodiments of the present disclosure. It will be apparent to those skilled in the art that other figures can be obtained from the structures illustrated in the drawings without the inventive effort.

FIG. 18 is a perspective schematic structural diagram of the flexible isolation pad in

FIG. 13;

DESCRIPTION OF REFERENCE NUMERALS

TABLE 1

Figure 1:
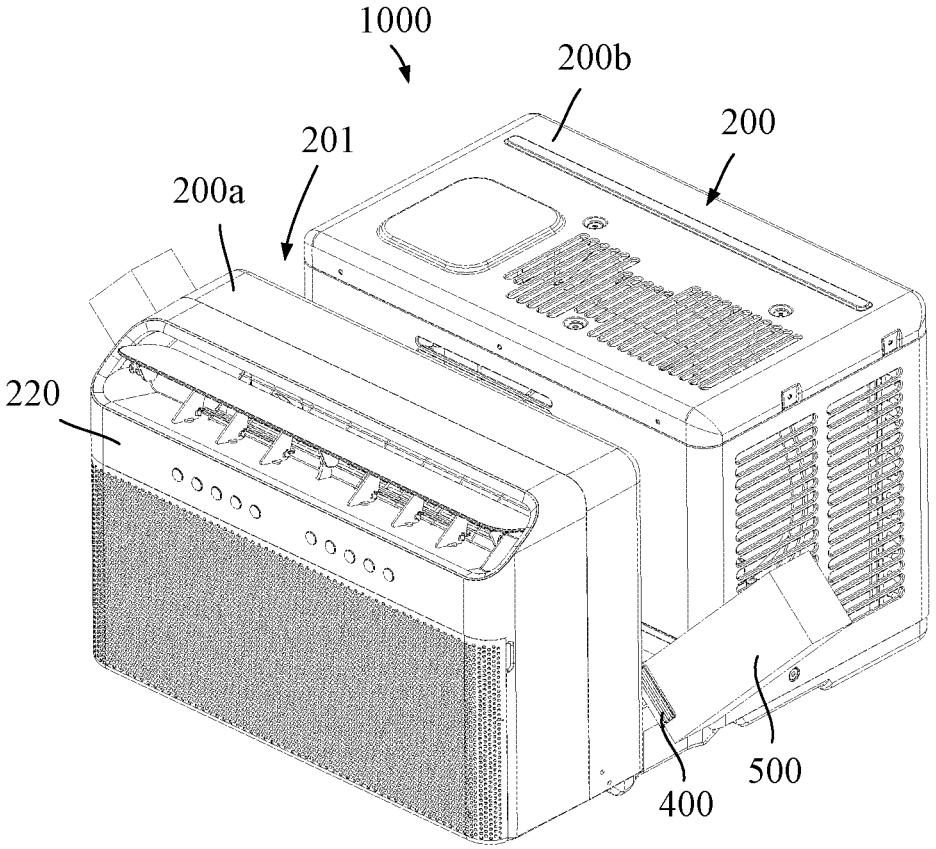
FIG. 1 is a schematic structural diagram of a window air conditioner according to an embodiment of the present disclosure.

| Reference Numeral | Name |
|---|---|
| 1000 | window air conditioner |
| 100 | display assembly |
| 10 | display box |
| 11 | base plate |
| 111 | key via hole |
| 1111 | sealing ring protrusion |
| 112 | connection protrusion |
| 113 | lamp mounting hole |
| 114 | digital display protrusion |
| 115 | digital display through hole |
| 116 | alarm avoiding through hole |
| 117 | remote control avoiding through hole |
| 118 | screw hole pillar |
| 119 | positioning pillar |
| 12 | upper plate |
| 121 | elastic pressing plate |
| 1211 | pressing surface |
| 1212 | guiding surface |
| 122 | first locking protrusion |
| 123 | first positioning notch |
| 13 | lower plate |
| 131 | elastic pressing buckle |
| 1311 | clamping protrusion |
| 132 | first blocking protrusion |
| 133 | second positioning notch |
| 14 | right plate |
| 141 | second locking protrusion |
| 15 | left plate |
| 151 | screw connection portion |
| 16 | cable opening |
| 20 | thermal-insulation cover |
| 21 | first limiting groove |
| 211 | limiting surface |
| 22 | second limiting groove |
| 23 | first anti-sinking protrusion |
| 24 | second anti-sinking protrusion |
| 25 | crimping protrusion |
| 26 | first positioning protrusion |
| 27 | second positioning protrusion |
| 30 | electric control board |
| 31 | key switch |
| 32 | indicator light |
| 33 | digital display light |
| 34 | alarm |
| 35 | remote control receiver |
| 36 | connection via hole |
| 37 | positioning hole |
| 40 | flexible isolation pad |
| 41 | control key |
| 42 | annular movable portion |
| 43 | first sink groove |
| 431 | key groove |
| 432 | annular groove |
| 44 | second sink groove |
| 45 | connection hole |
| 46 | first avoiding groove |
| 47 | second avoiding groove |
| 48 | connection avoiding hole |
| 49 | positioning avoiding hole |
| 200 | housing |
| 210 | key mounting hole |
| 220 | display panel |

TABLE 1-continued

| Reference Numeral | Name |
|---|---|
| 230 | connection plate |
| 240 | air inlet panel |
| 250 | first elastic buckle |
| 260 | second elastic buckle |
| 270 | second blocking protrusion |
| 280 | face frame |
| 201 | partition groove |
| 202 | air inlet |
| 203 | air outlet |
| 200a | indoor unit |
| 200b | outdoor unit |
| 300 | indoor heat exchanger |
| 400 | mounting base |
| 500 | sealing member |

The realization of the objective, functional characteristics, advantages of the present disclosure are further described with reference to the accompanying drawings.

DETAILED DESCRIPTION OF THE EMBODIMENTS

The technical solutions of the embodiments of the present disclosure will be described in more detail in the following with reference to the accompanying drawings. It is obvious that the embodiments to be described are only some rather than all of the embodiments of the present disclosure. All other embodiments obtained by persons skilled in the art based on the embodiments of the present disclosure without creative efforts shall fall within the scope of the present disclosure.

It should be noted that, the descriptions, such as "first," "second" in some embodiments of the present disclosure, are for descriptive purposes only, and cannot be understood as indicating or suggesting relative importance or impliedly indicating the number of the indicated technical feature. Therefore, the feature associated with the "first," the "second" can express or impliedly include at least one feature.

Besides, the meaning of "and/or" appearing in the full text includes three paratactic schemes. Take "A and/or B" as an example, including the A scheme, or the B scheme, or the scheme in which both A and B are simultaneously satisfied.

The present disclosure provides a display assembly and a window air conditioner including the display assembly.

As shown in FIGS. 1, 2, 5 and 6, a display assembly 100 is applied to a window air conditioner 1000. The window air conditioner further includes a housing 200. The display assembly 100 is provided in the housing 200. The housing 200 includes a face frame 280. A display area is provided at the face frame 280, and the display assembly 100 is installed in the display area.

In some embodiments of the present disclosure, as shown in FIGS. 1, 2, and 5-8, the face frame 280 includes a display panel 220; a connection plate 230 provided at a lower edge of the display panel 220 and extending inwards; and an air inlet panel 240 provided at an inner edge of the connection plate 230 and extending downwards. An air outlet 203 is provided above the display panel 220, and an air inlet 202 is provided at the air inlet panel 240. The display area is provided at the display panel 220. Specifically, the display assembly 100 is provided above the connection plate 230. The display assembly 100 may be connected to the connection plate 230 and/or the display panel 220.

Figure 5:
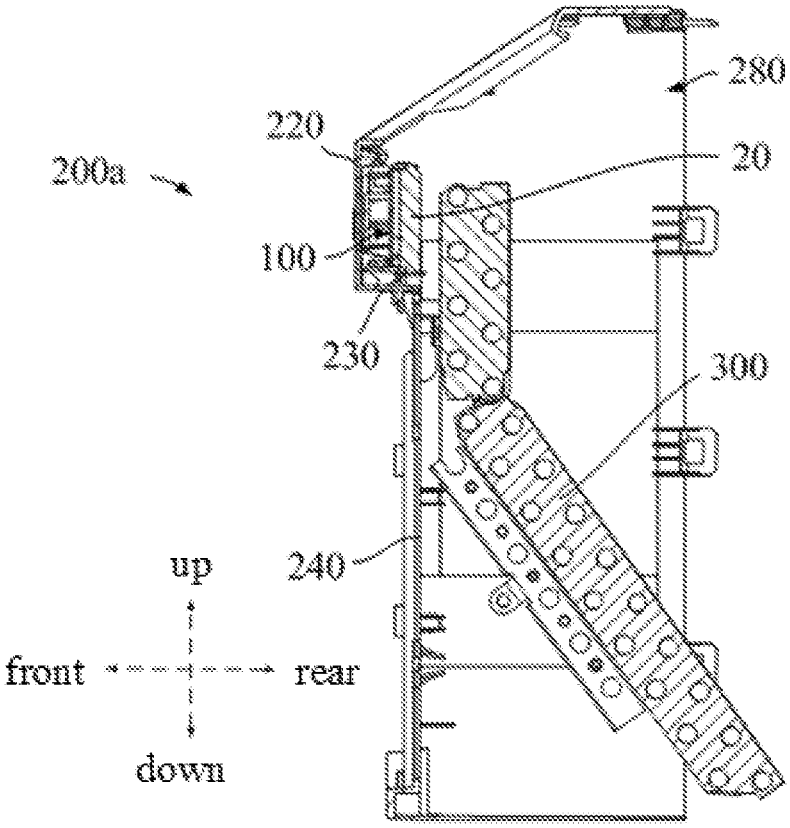
FIG. 5 is a schematic cross-sectional structural diagram of the indoor portion of the window air conditioner in FIG. 1.
Figure 6:
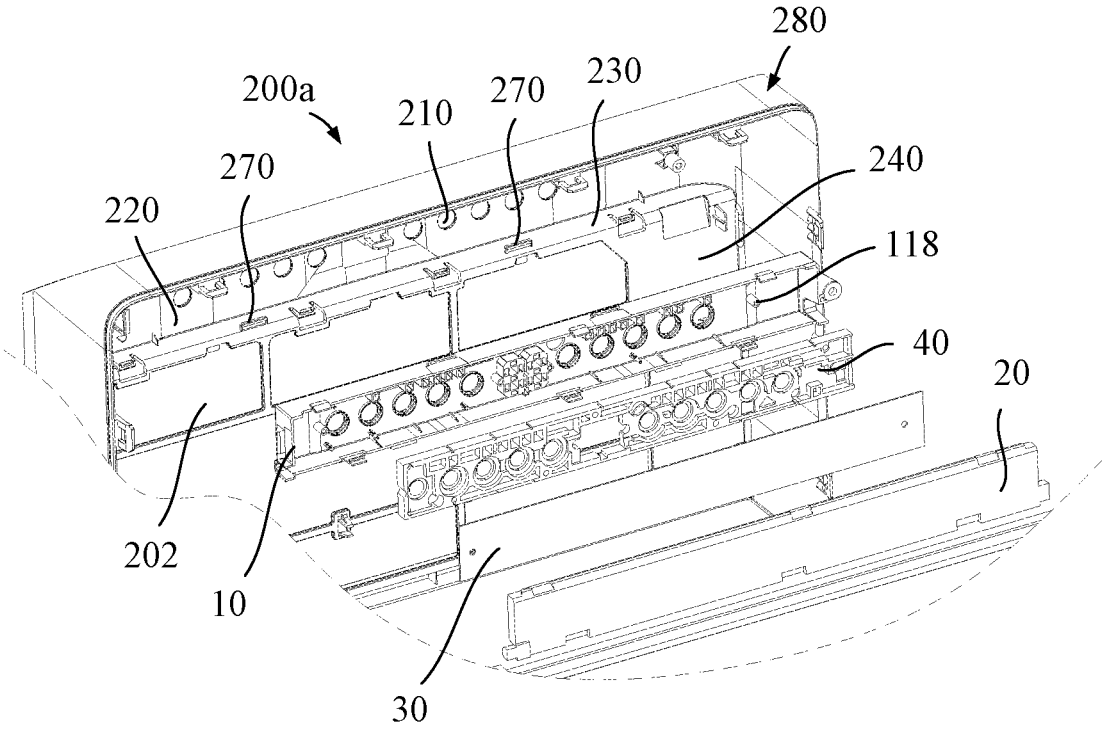
FIG. 6 is a schematic exploded view of the indoor portion of the window air conditioner in FIG. 5.
Figure 7:
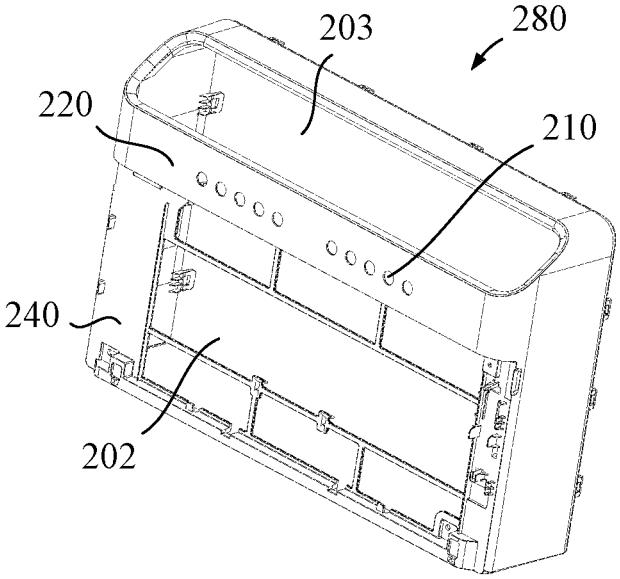
FIG. 7 is a schematic structural diagram of the face frame in FIG. 2 from a perspective.
Figure 8:
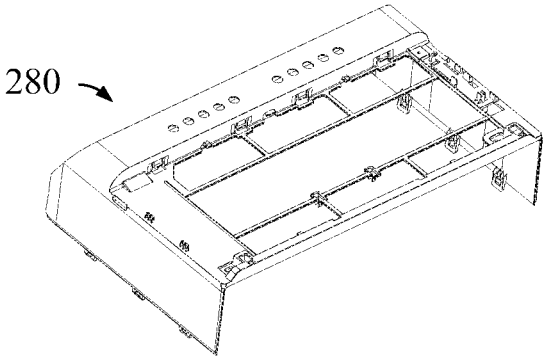
FIG. 8 is a schematic structural diagram of the face frame in FIG. 7 from another perspective.
Figure 9:
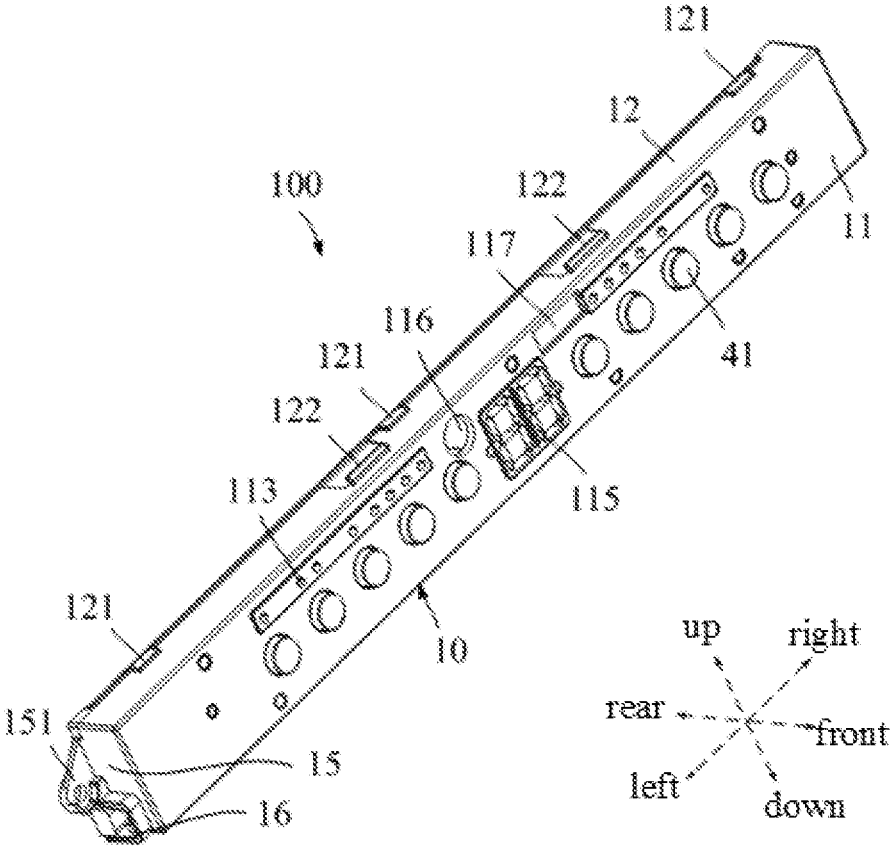
FIG. 9 is a schematic structural diagram of the display assembly in FIG. 2 from a perspective.

It should be noted that, if there is directional indication (such as up, down, left, right, front, rear . . . ) in the embodiments of the present disclosure, the directional indication is only used to explain the relative positional relationship and movement between the components in a certain posture (as shown in FIGS. 5 and 9). If the specific posture changes, the directional indication changes accordingly.

In an embodiment, as shown in FIGS. 6, 9, 10, 12 and 13, the display assembly 100 includes:

a display box 10, the display box 100 including a base plate 11 having a display portion and a key via hole 111;

an electric control board 30 provided in the display box 10;

a flexible isolation pad 40 provided in the display box 10, the flexible isolation pad 40 being located between the base plate 11 and the electric control board 30, and configured to isolate the base plate 11 from the electric control board 30; and a control key 41 movably provided in the key via hole 111, the control key 41 being configured to abut against the flexible isolation pad 40, and configured to interact with the electric control board 30 through the flexible isolation pad 40.

The display box 10 has a receiving cavity (not shown), and the electric control board 30 and the flexible isolation pad 40 are both provided in the receiving cavity.

As shown in FIGS. 1, 2, 5 and 6, when the display assembly 100 is applied to the window air conditioner 1000, the base plate 11 is provided at the face frame 280. In detail, a display area is provided at the face frame 280, and the base plate 11 is installed in the display area. In more detail, the electric control board 30 is provided with a key switch 31, the key via hole 111 is corresponding to the key switch 31, and the control key 41 is corresponding to the key switch 31. The display area is provided with a key mounting hole 210 corresponding to the key switch 31. As such, a control key 41 is provided in the key via hole 111 and the key mounting hole 210 to control the key switch 31 on the electric control board 30.

Besides, in the technical solutions of the present disclosure, a flexible isolation pad 40 is provided between the base plate 11 and the electric control board 30. On the one hand, the flexible isolation pad 40 may isolate the cold air entering the display box from the key mounting hole 210 and the key via hole 111 to prevent the condensate from forming on the electronic control board 30, and may form two layers of isolation protection for the base plate 11 and the flexible isolation pad 40, which can improve the protection effect on the electronic control board 30 to prevent the failure of the electronic control board 30 and the display assembly 100, thereby effectively improving the use reliability of the display assembly 100 and the window air conditioner 1000. On the other hand, due to the flexibility of the flexible isolation pad 40, the flexible isolation pad 40 may be deformed so as not to affect the effect of the control key 41 on the key switch 31 on the electric control board 30.

In a specific embodiment, the flexible isolation pad 40 may be a silicone pad or a soft rubber pad. In this embodiment, the flexible isolation pad 40 is a silicone pad.

Further, the flexible isolation pad 40 is attached to a periphery of the key via hole 111. As such, the sealing effect of the flexible isolation pad 40 on the key via hole 111 can be improved, such that cold air can be prevented from entering the display box 10 to further prevent the condensate from forming on the electric control board 30. Optionally, the flexible insulation pad 40 is (closely) attached to a side of the base plate 11 towards, i.e., facing, the flexible insulation pad 40.

Figure 12:
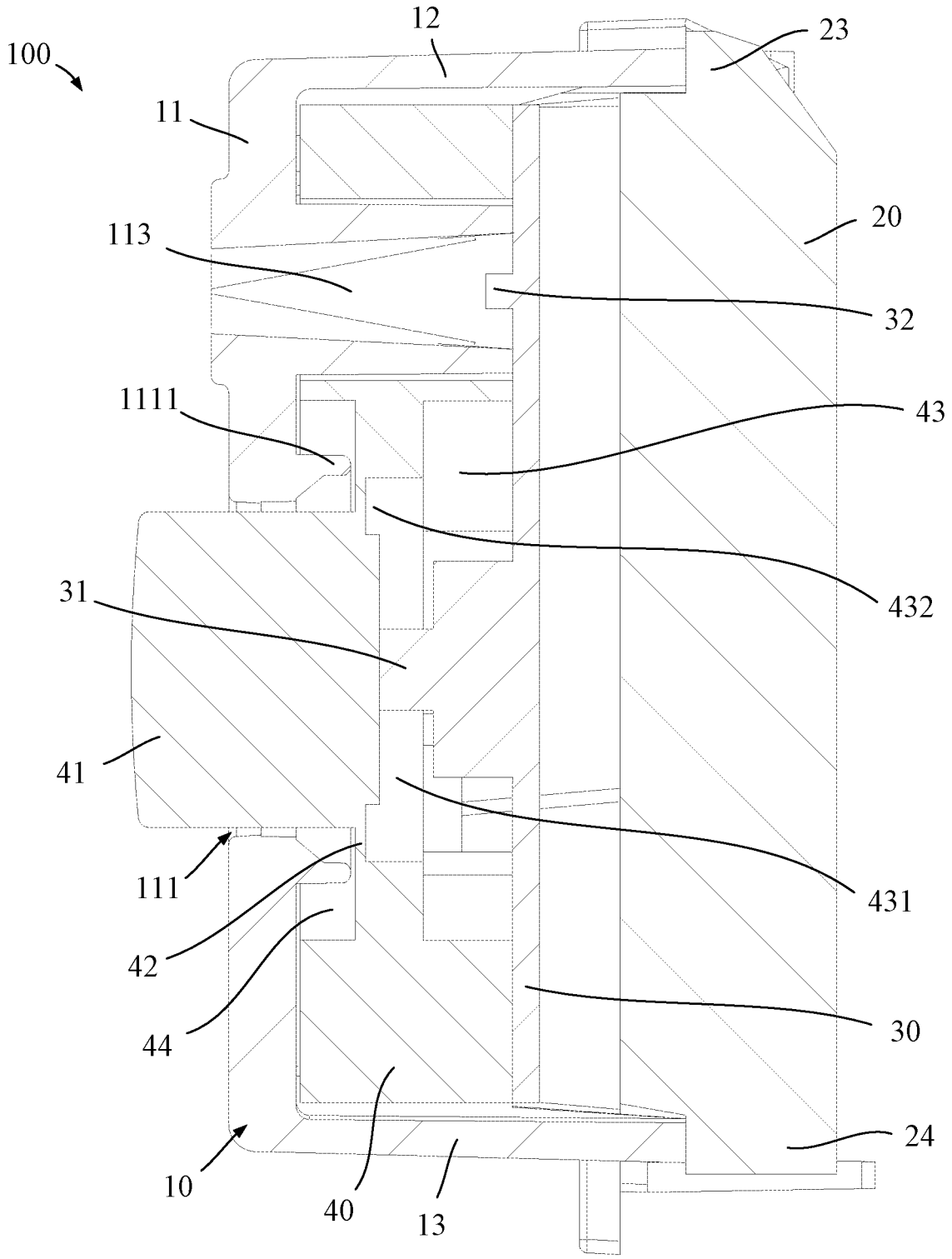
FIG. 12 is a schematic cross-sectional view of the display assembly taken along line I-I in FIG. 11.
Figure 16:
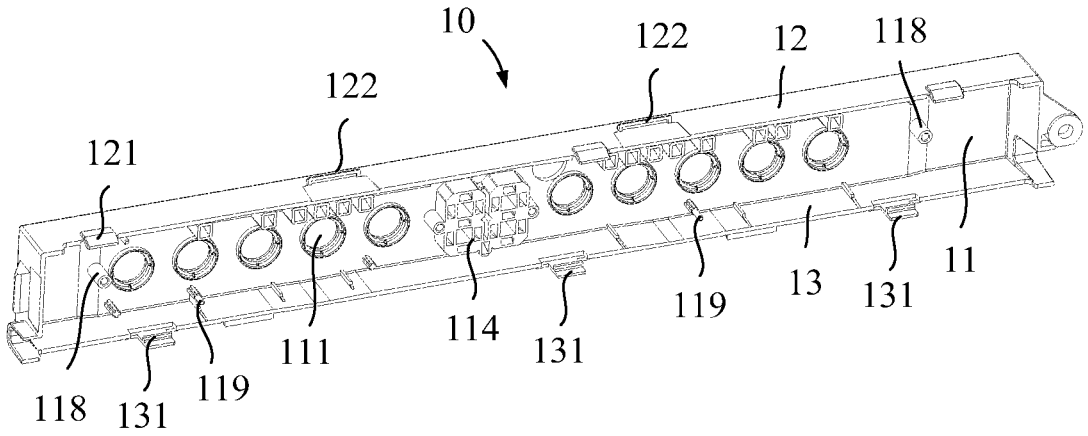
FIG. 16 is a schematic structural diagram of the display box in FIG. 14 from another perspective.

Further, as shown in FIGS. 12 and 16, a sealing ring protrusion 1111 protrudes from the side of the base plate 11 towards the flexible isolation pad 40, and the sealing ring protrusion 1111 is provided outside the key via hole 111. The control key 41 is provided inside the sealing ring protrusion 1111, and the sealing ring protrusion 1111 abuts against the side of the flexible isolation pad 40 towards the base plate 11. As such, the sealing performance of the flexible isolation pad 40 to the key via hole 111 can be improved.

Further, as shown in the figure, the flexible isolation pad 40 is at least partially attached to a periphery of the electric control board 30. As such, the protective effect of the flexible isolation pad 40 on the electrical control board 30 can be improved to prevent cold air from entering the side of the electric control board 30 from the periphery of the electric control board 30 towards the side of the flexible insulation pad 40 to prevent the formation of condensate.

Further, as shown in FIGS. 6, 9, 10, 12, 13 and 21, the control key 41 is integrated with the flexible isolation pad 40.

Specially, as shown in FIGS. 9 and 12, the control key 41 protrudes from the key via hole 111 in a direction away from the electric control board 30 for extending into the key mounting hole 210 on the face frame 280. As such, the switch of the key switch 31 can be controlled by driving the control key 41 to move; and the control key 41 can play a role of sealing the key mounting hole 210.

As such, by integrally forming the control key 41 on the flexible isolation pad 40, the control key 41 can play a role of sealing the key via hole 111, thereby improving the isolation effect of the flexible isolation pad 40, and improving the sealing effect. Moreover, the corresponding assembly process can be reduced, the installation process can be simplified, and the installation efficiency can be improved. In addition, the soft control key 41 has a comfortable pressing feel, which can improve user comfort.

Of course, it is also possible to provide independent control key (the control key can be a plastic key) in the key via hole 111 and the button mounting hole 210, so that the key switch 31 can also be controlled.

Figure 21:
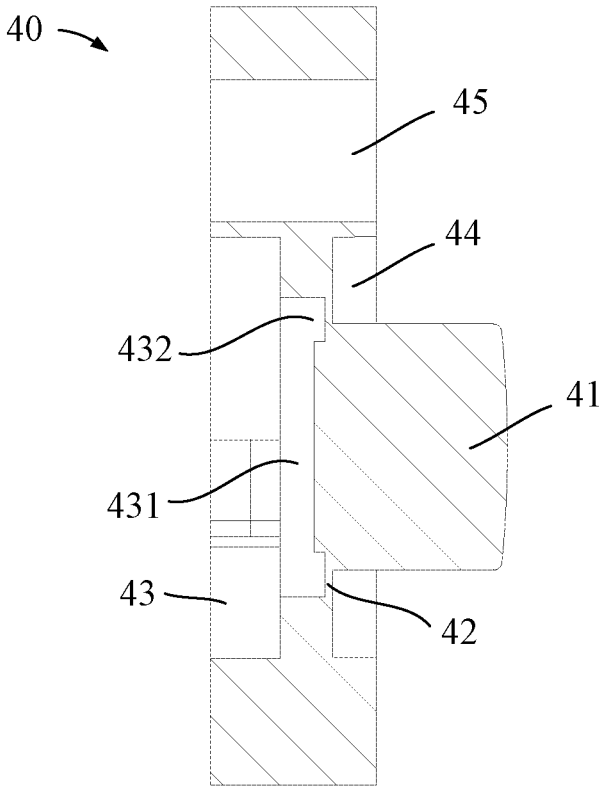
FIG. 21 is a schematic cross-sectional view of the flexible isolation pad taken along line II-II in FIG. 20.

Further, as shown in FIGS. 12 and 21, the flexible isolation pad 40 is provided with an annular movable portion 42 outside the control key 41, and a thickness of the annular movable portion 42 is smaller than a thickness of the flexible isolation pad outside the annular movable portion 42 (i.e., the side of the annular movable portion 42 away from, i.e., facing away from, the control key 41). In this way, the pressing force required when the control key 41 is pressed can be reduced, thereby reducing the difficulty of operation and improving the user experience; meanwhile it can also improve the hand feeling when pressing.

In a specific embodiment, there are many ways to form the annular movable portion 42. For example, a first annular groove is provided at the side of the flexible isolation pad 40 away from the base plate 11, and a second annular groove is provided at the side of the flexible isolation pad 40 towards the base plate 11 corresponding to the first annular groove. Moreover, both the first annular groove and the second annular groove are provided outside the control key 41, so that the annular movable portion 42 can be formed outside the control key 41. And optionally, the first annular groove and the second annular groove are both arc-shaped in cross section; and so on. In this embodiment, the annular movable portion 42 is formed in another way, as described in detail below.

Further, as shown in FIGS. 12 and 18-20, a first sink groove 43 is provided at a side of the flexible isolation pad 40 away from the base plate 11 corresponding to the control key 41;

and/or a second sink groove 44 is provided at a side of the flexible isolation pad 40 towards the base plate 11, and the control key 41 is provided at a bottom of the second sink groove 44.

Optionally, the first sink groove 43 and the second sink groove 44 are both circular grooves, and their diameter is greater than the radial dimension of the control key 41.

In this way, the pressing force required when the control key 41 is pressed can be reduced, and the annular movable portion 42 can be easily formed outside the control key 41.

The first sink groove 43 can also be used to avoid other components on the electric control board 30.

In this embodiment, a first sink groove 43 is provided at a side of the flexible isolation pad 40 away from the base plate 11 corresponding to the control key 41, a second sink groove 44 is provided at a side of the flexible isolation pad 40 towards the base plate 11, and the control key 41 is provided at a bottom of the second sink groove 44.

Further, as shown in FIGS. 12 and 18-21, a key groove 431 is provided at the bottom of the first sink groove 43, and a button of a key switch 31 is provided in the key groove 431. As such, the pressing force required when the control key 41 is pressed can be further reduced to facilitate pressing the key switch 31.

Further, as shown in FIGS. 12 and 18-21, an annular groove 432 is provided at the bottom of the key groove 431, and the annular groove 432 is provided at a periphery of the control key 41. As such, the annular movable portion 42 can be formed outside the control key 41, and the pressing feel can be better improved.

Figure 13:
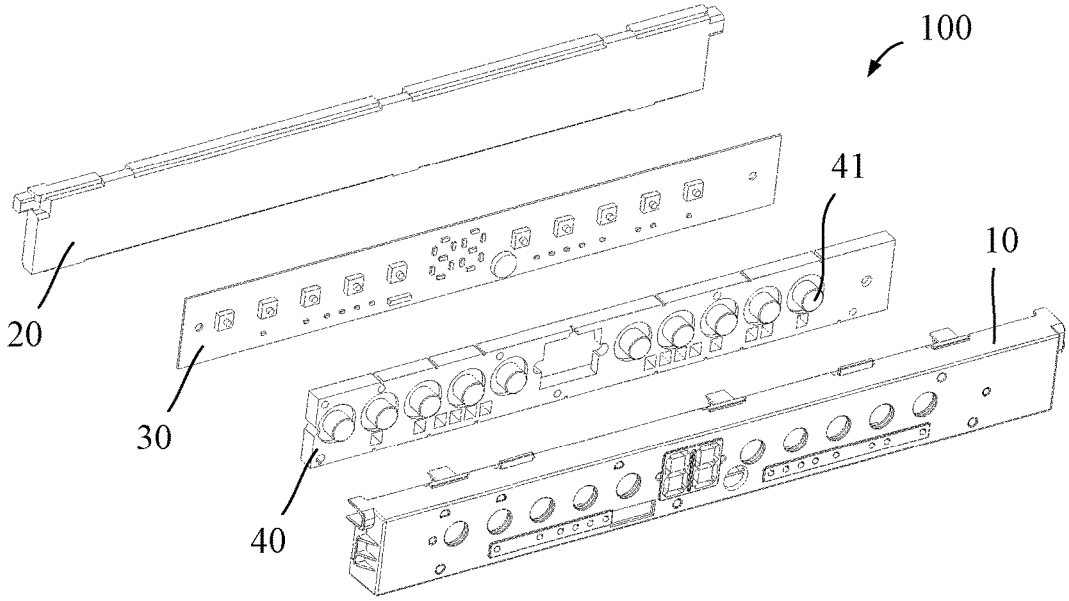
FIG. 13 is an exploded schematic structural diagram of the display assembly in FIG. 9.
Figure 26:
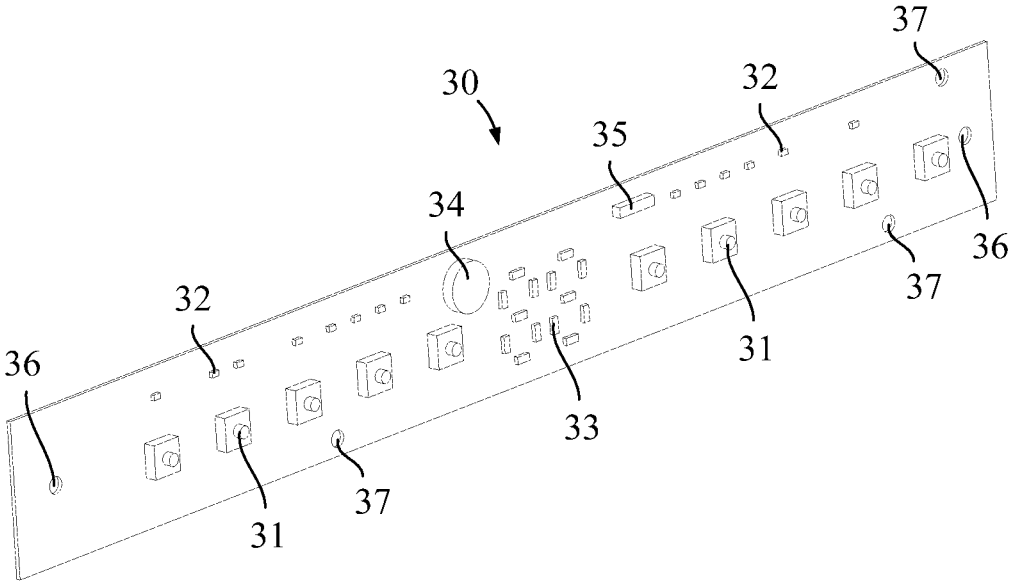
FIG. 26 is a schematic structural diagram of the electric control board in FIG. 13.

In this embodiment, as shown in FIGS. 13 and 26, key switches 31 are spaced apart from each other in the length direction of the electric control board 30 (that is, two or more, the same below).

Correspondingly, as shown in FIGS. 9 and 13, control keys 41 are spaced apart from each other in the length direction of the flexible isolation pad 40. The first sink grooves 43 are spaced apart from each other in the length direction of the flexible isolation pad 40. The second sink grooves 44 are spaced apart from each other in the length direction of the flexible insulation pad 40.

Correspondingly, as shown in FIGS. 13 and 16, the key via holes 111 are spaced apart from each other in the length direction of the display box 10.

Correspondingly, as shown in FIGS. 1 and 6-8, the key mounting holes 210 are spaced apart from each other in the width direction of the housing 200.

Figure 18:
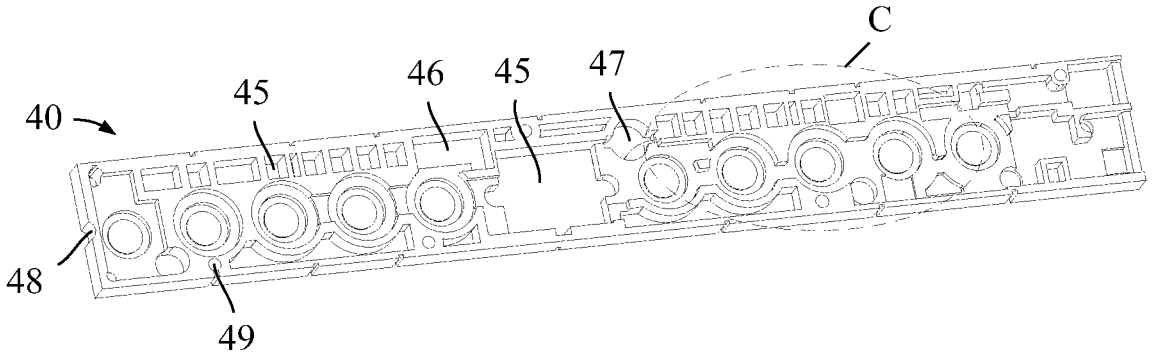
Figure 19:
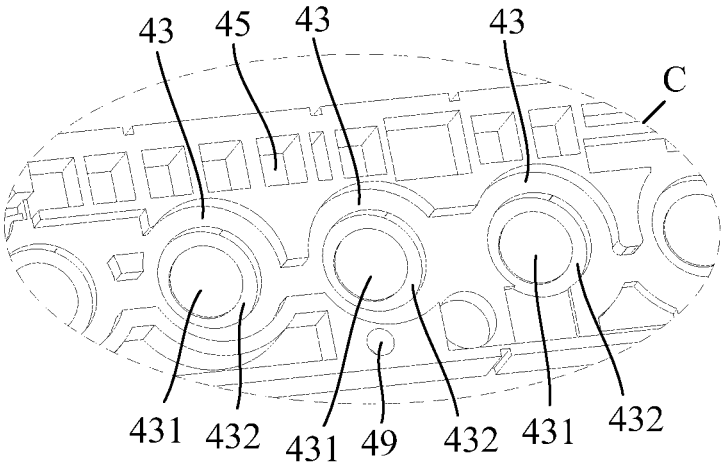
FIG. 19 is a partial enlarged view of portion C in FIG. 18.
Figure 20:
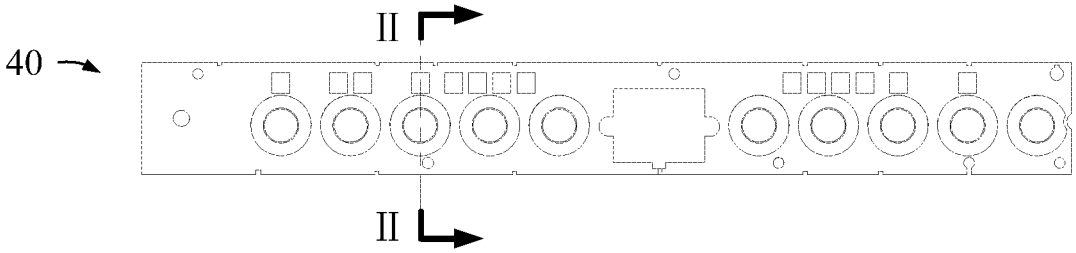
FIG. 20 is a front view of the flexible isolation pad in FIG. 13.

Specifically, as shown in FIGS. 18 and 19, the partially adjacent first sink groove 43 communicates with each other. In this way, on the one hand, the flexibility of the flexible insulation pad 40 can be improved, and on the other hand, the air circulation between the flexible insulation pad 40 and the electric control board 30 can be improved.

Further, as shown in FIGS. 13, 14, 16, 18, 19 and 26, an indicator light 32 protrudes from the electric control board 30, a connection hole 45 is provided at the flexible isolation pad 40, and a connection protrusion 112 protrudes from a side of the base plate 11 towards the flexible isolation pad 40, the display portion includes a lamp mounting hole 113 provided at the connection protrusion 112, the lamp mounting hole 113 is configured to penetrate the base plate 11, the connection protrusion 112 is inserted into the connection hole 45, and the indicator light 32 is provided in the lamp mounting hole 113.

The connection hole 45 is not only configured to avoid the indicator light 32, so that the indicator light 32 can be provided in the lamp mounting hole 113; but also configured to position and limit the flexible insulation pad 40 and the base plate 11 by cooperating with the connection protrusion 112, so as to improve the connection stability between the flexible insulation pad 40 and the base plate 11.

In this embodiment, the display panel 220 is translucent but not transparent, so that the light of the indicator light 32 can be displayed. Of course, in other embodiments, a light-transmitting hole may be provided at the display panel 220, or a transparent light-transmitting window may be provided at the display panel 220.

In this embodiment, as shown in FIGS. 13 and 26, the indicator lights 32 are spaced apart from each other in the length direction of the electric control board 30. Correspondingly, as shown in FIG. 18, the connection holes 45 are spaced apart from each other in the length direction of the flexible insulation pad 40.

Further, as shown in FIGS. 9 and 16, a digital display protrusion 114 protrudes from a side of the base plate 11 towards the flexible isolation pad 40, the display portion includes a digital display through hole 115 provided at the digital display protrusion 114, the flexible isolation pad 40 is provided with an avoiding through hole, and the digital display protrusion 114 is provided in the avoiding through hole. Correspondingly, the electric control board 30 is provided with a digital display light 33, and the digital display light 33 is provided in the digital display through hole 115.

In this embodiment, the digital display through hole 115 is a double eight display hole, and the digital display light 33 is a double eight display light.

In this way, it can be used to display temperature or humidity.

In this embodiment, the display panel 220 has a light-transmitting opacity, so that the number displayed by the digital display lamp 33 can be displayed.

Further, as shown in FIGS. 16 and 18, the left side and the right side of the digital display protrusion 114 are provided with convex pillars, and the left side and the right side of the avoiding through hole are correspondingly provided with grooves for the avoiding convex pillars.

A protrusion is provided at the lower side of the digital display protrusion 114, and a concave portion (not shown) is provided at the lower side of the avoiding through hole corresponding to the protrusion.

In this embodiment, as shown in FIGS. 18 and 19, some control keys 41 are located on a side of the avoiding through hole, and the remaining control keys 41 are located on the other side of the avoiding through hole. Correspondingly, some of the first sink grooves 43 are provided at a side of the avoiding through hole, and the remaining first sink grooves 43 are provided at the other side of the avoiding through hole, and so on. Optionally, the first sink grooves 43 located on the same side of the avoiding through hole communicate with each other.

In this embodiment, some of the connection holes 45 are provided at a side of the avoiding through hole, and the remaining connection holes 45 are provided at the other side of the avoiding through hole.

Further, as shown in FIGS. 18 and 26, an alarm 34 protrudes from the electrical control board 30, a first avoiding groove 46 is provided at a side of the flexible isolation pad 40 away from the base plate 11 corresponding to the alarm 34, and the alarm 34 is provided in the first avoiding groove 46. As such, the alarm can be realized.

Specifically, the base plate 11 is provided with an alarm avoiding through hole 116 corresponding to the alarm 34 to reduce the obstruction of sound transmission.

In this embodiment, the alarm 34 is a buzzer.

Further, as shown in FIGS. 18 and 26, a remote control receiver 35 protrudes from the electric control board 30, and a second avoiding groove 47 is provided at a side of the flexible isolation pad 40 away from the base plate 11 corresponding to the remote control receiver 35, and the remote control receiver 35 is provided in the second avoiding groove 47. As such, remote control can be achieved.

Specifically, the base plate 11 is provided with a remote control avoiding through hole 117 corresponding to the remote control receiver 35, so as to reduce the obstruction of signal transmission.

It should be understood that, the side of the flexible isolation pad 40 away from the base plate 11 is also provided with an avoiding groove for avoiding other components on the electronic control board 30, which need not be repeated here.

Further, the electric control board 30 is connected with the base plate 11 through a screw lock structure. In this way, the connection strength between the electric control board 30 and the base plate 11 can be ensured/improved to prevent the electric control board 30 from shaking within the display box 10 to improve the reliability of the display assembly 100.

Further, as shown in FIGS. 14, 16, 18 and 26, a screw hole pillar 118 protrudes from the side of the base plate 11 towards the flexible isolation pad 40, and a connection via hole 36 is provided at the electric control board 30. The flexible isolation pad 40 is provided with a connection avoiding hole 48, and the screw hole pillar 118 passes through the connection avoiding hole 48 and is screwed with the connection via hole 36 (via a screw).

Specially, the screw hole pillar 118 passes through the connection avoiding hole 48 and is aligned with the connection via hole 36. Fasteners (such as screws) pass through the connection via hole 36 and are screwed to the screw holes on the screw hole pillar 118.

Optionally, a plurality of the screw hole pillars 118 are provided.

Further, as shown in FIGS. 14, 16, 18 and 26, a positioning pillar 119 protrudes from the side of the base plate 11 towards the flexible isolation pad 40, and a positioning hole 37 is provided at the electric control board 30. The flexible isolation pad 40 is provided with a positioning avoiding hole 49. The positioning pillar 119 passes through the positioning avoiding hole 49 and is inserted into the positioning hole 37. In this way, by providing the positioning hole 37 and the positioning pillar 119, it is convenient to position the electric control board 30 and the base plate 11 during assembly.

Optionally, a plurality of the positioning pillars 119 are provided.

In a specific embodiment, there are many structural forms of the display box 10, for example, two sub-boxes are spliced together, and so on. In this embodiment, the display box 10 is open at one end, as described in detail below.

Figure 14:
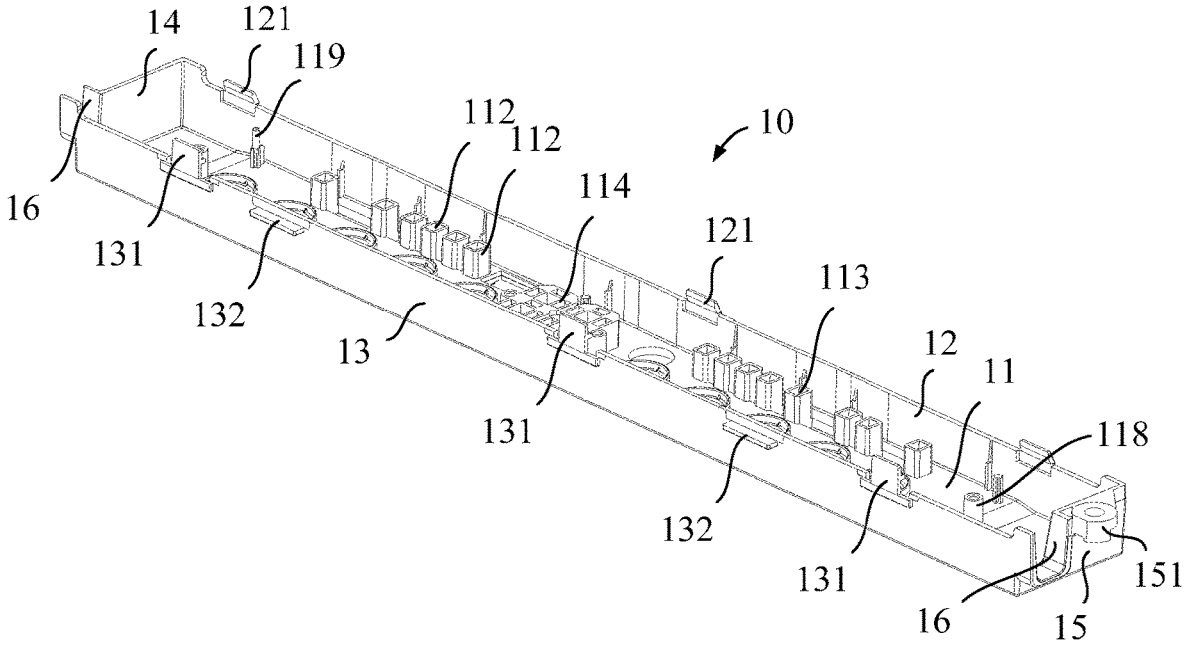
FIG. 14 is a schematic structural diagram of the display box in FIG. 13 from a perspective.

Further, as shown in FIGS. 14 and 16, the display box 10 further includes a surrounding plate provided at a periphery of the base plate 11, an opening is formed at an end of the surrounding plate away from the base plate 11, and the display assembly 100 further includes a cover covering the opening. The cover is disposed opposite to the base plate 11. In this way, by making the display box 10 open at one end, it is convenient to install the flexible isolation pad 40 and the electric control board 30. Meanwhile, by covering the cover at the opening, the electric control board 30 can be sealed in the display box 10 to further protect the electric control board 30.

Further, the cover is a thermal-insulation cover 20, so that the inside and outside of the display box 10 can be insulated, so as to avoid condensate in the display box 10, to prevent the failure of the electric control panel 30 and the display assembly 100, such that the use reliability of the display assembly 100 and the window air conditioner 1000 can be effectively improved.

It should be particularly pointed out that in the technical solution of the present disclosure, by providing a flexible isolation pad 40 between the electric control board 30 and the base plate 11, the front side of the electric control box can be isolated from condensate. Meanwhile, by setting the cover of the display box 10 as the thermal-insulation cover 20, condensate on the rear side of the display assembly 100 can be avoided. Therefore, the display box 10 can have good sealing and heat insulation, and the use reliability of the display assembly 100 and the window air conditioner 1000 can be greatly improved.

Figure 2:
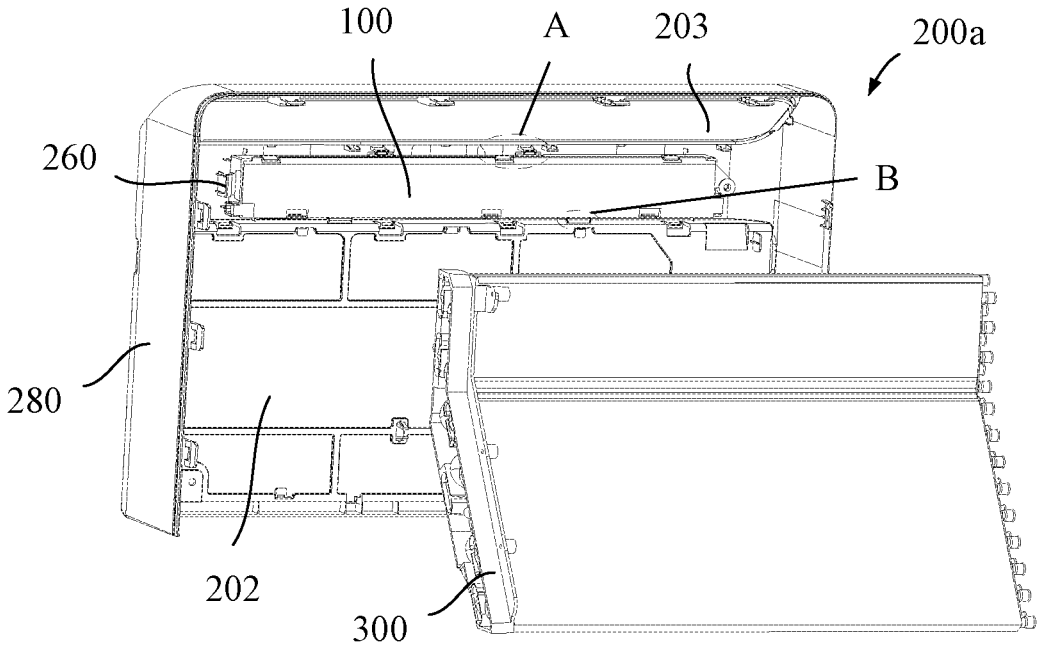
FIG. 2 is a schematic diagram of the internal structure of the indoor portion of the window air conditioner in FIG. 1.
Figure 3:
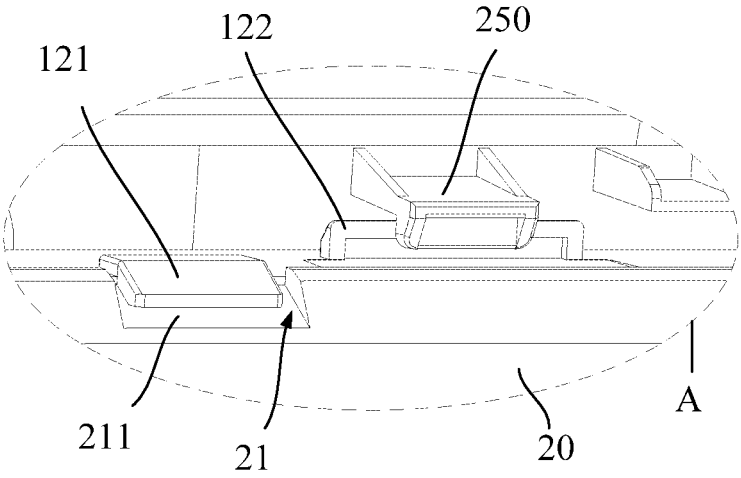
FIG. 3 is an enlarged view of portion A in FIG. 2.
Figure 4:
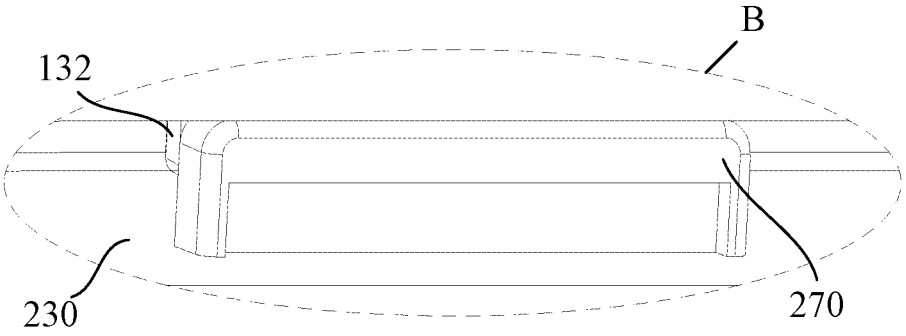
FIG. 4 is an enlarged view of portion B in FIG. 2.

In this embodiment, as shown in FIGS. 2 and 5, the window air conditioner 1000 further includes an indoor heat exchanger 300, and an upper portion of the indoor heat exchanger 300 is disposed near the thermal-insulation cover 20.

Optionally, the thermal-insulation cover 20 is a foam piece. In this way, both good sealing and good heat insulation can be achieved, which solves the problem that the display assembly 100 closer to the evaporator is prone to condensate and improves product reliability.

Further, the thermal-insulation cover 20 is detachably provided at the opening to open or cover the opening. As such, the electric control board 30 and the like can be easily repaired and replaced.

Specifically, the thermal-insulation cover 20 is connected to the display box 10 through a clamping structure, so that the thermal-insulation cover 20 is detachably provided at the opening. As such, the connection between the thermal-insulation cover 20 and the display box 10 becomes simple and convenient.

Further, as shown in FIGS. 14 and 16, elastic limiters spaced apart from each other protrude from a periphery of the opening, and the thermal-insulation cover 20 is clamped between the elastic limiters. As such, the thermal-insulation cover 20 can be limited at the opening.

Further, as shown in FIGS. 9, 10, 14, 16 and 22-25, the elastic limiter includes an elastic pressing plate 121, a side surface of the elastic pressing plate 121 towards the thermal-insulation cover 20 includes a pressing surface 1211 inclined towards an inner side of the opening (i.e., a side towards a center of the opening), and a side surface of the thermal-insulation cover 20 away from the electric control board 30 is provided with a limiting surface 211 cooperated with the pressing surface 1211. As such, the elastic pressing plate 121 can prevent the thermal-insulation cover 20 from moving away from the base plate 11.

In this embodiment, the end of the elastic pressing plate 121 extends obliquely towards the inside of the opening to form the pressing surface 1211.

Figure 15:
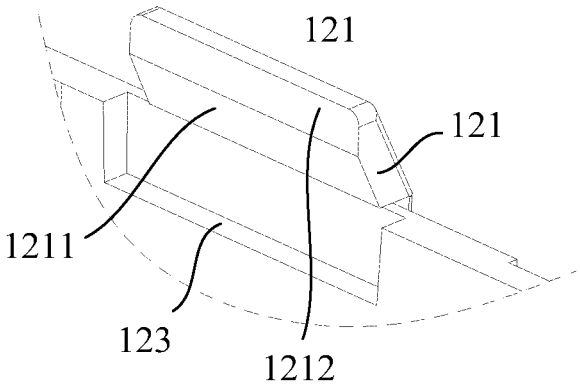
FIG. 15 is a partial enlarged view of the elastic pressing plate in FIG. 14.

Further, as shown in FIGS. 14 and 15, the side surface of the elastic pressing plate 121 towards the thermal-insulation cover 20 further includes a guiding surface 1212 provided at the side of the pressing surface 1211 away from the base plate 11. The guiding surface 1212 is connected with the pressing surface 1211, and the guiding surface 1212 and the pressing surface 1211 are disposed at an angle. The guiding surface 1212 is used to guide the elastic pressing plate 121 to be assembled with the thermal-insulation cover 20.

Further, as shown in FIGS. 9, 10 and 22-25, a first limiting groove 21 is provided at the side of the temperature-isolating cover 20 away from the electric control board 30, and the elastic pressing plate 121 is provided in the first limiting groove 21. The limiting surface 211 is disposed at the bottom of the first limiting groove 21. As such, the elastic pressing plate 121 can be limited in the first limiting groove 21, so that it not only can be aligned during assembly, but also can limit the elastic pressing plate 121 after assembly.

Further, as shown in FIGS. 9, 10, 14, 16 and 22-25, the display box 10 further includes an upper plate 12 provided at the upper edge of the base plate 11, and the elastic pressing plate 121 is provided at a side edge of the opening of the upper plate 12. The elastic pressing plates 121 are spaced apart from each other in the length direction of the upper plate 12. Correspondingly, the first limiting groove 21 is provided at the upper edge of the thermal-insulation cover 20 and is spaced apart from each other in the length direction of the thermal-insulation cover 20. As such, the installation stability can be improved.

Figure 23:
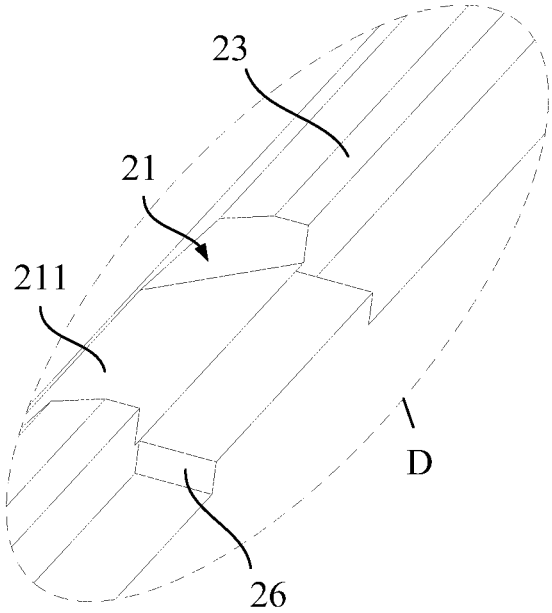
FIG. 23 is a partial enlarged view of portion D in FIG. 22.

Further, as shown in FIGS. 15 and 23, the inner side of the open side edge of the upper plate 12 is provided with a first positioning notch 123 corresponding to the elastic pressing plate 121. A first positioning protrusion 26 is provided at the upper edge of the thermal-insulation cover 20, and the first positioning protrusion 26 is provided in the first positioning notch 123.

Further, as shown in FIGS. 9, 10, 14, 16, and 22-25, the elastic limiter includes an elastic pressing buckle 131, the elastic pressing buckle 131 includes a clamping protrusion 1311 provided at a side towards the thermal-insulation cover 20, and the clamping protrusion 1311 is clamped on a side of the thermal-insulation cover 20 away from the electric control board 30. As such, the elastic pressing buckle 131 can prevent the thermal-insulation cover 20 from moving away from the base plate 11.

Further, as shown in FIGS. 9, 10 and 22-25, a second limiting groove 22 is provided at the side of the temperature-isolating cover 20 away from the electric control board 30, and the clamping protrusion 1311 is clamped with the bottom of the second limiting groove 22. In this way, the elastic pressing buckle 131 can be limited in the second limiting groove 22, so that the elastic pressing buckle 131 can be limited not only during assembly but also after the assembly is completed.

Further, as shown in FIGS. 9, 10, 14, 16 and 22-25, the display box 10 further includes a lower plate 13 provided at the lower edge of the base plate 11, and the elastic pressing buckle 131 is provided at a side edge of the opening of the lower plate 13. The elastic pressing buckle 131 are spaced apart from each other in the length direction of the lower plate 13. Correspondingly, the second limiting groove 22 is provided at the lower edge of the cover and is spaced apart from each other in the length direction of the thermal-insulation cover 20.

As such, the elastic pressing plate 121 and the elastic pressing buckle 131 are respectively provided at the upper and lower sides of the thermal-insulation cover 20, so that the thermal-insulation cover 20 can be firmly fixed at the opening. Moreover, through the cooperation between the elastic pressing plate 121 and the elastic pressing buckle 131, on the one hand, the connection stability can be ensured, and on the other hand, the assembly difficulty can be reduced.

Figure 17:
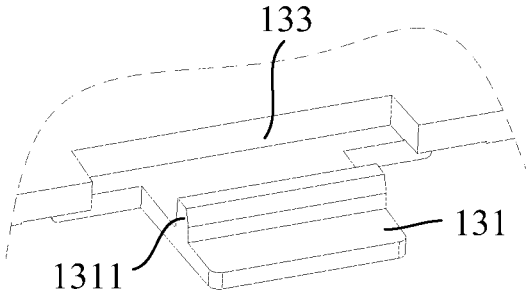
FIG. 17 is a partial enlarged view of the elastic pressing buckle in FIG. 16.
Figure 25:
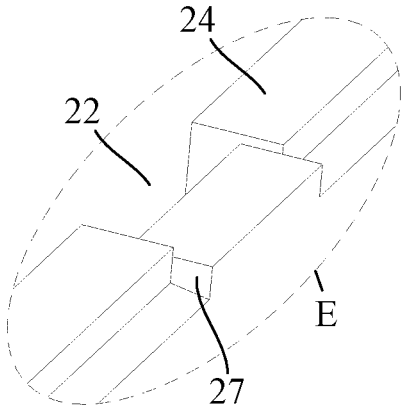
FIG. 25 is a partial enlarged view of portion E in FIG. 24.

Further, as shown in FIGS. 17 and 25, the inner side of the open side edge of the lower plate 13 is provided with a second positioning notch 133 corresponding to the elastic pressing buckle 131. A second positioning protrusion 27 is provided at the lower edge of the thermal-insulation cover 20, and the second positioning protrusion 27 is provided in the second positioning notch 133.

Further, as shown in FIG. 12, the thermal-insulation cover 20 is provided in the opening, and the periphery of the thermal-insulation cover 20 is provided with an anti-sinking protrusion, and the anti-sinking protrusion abuts on the periphery of the opening. In this way, it is possible to prevent the thermal-insulation cover 20 from completely sinking into the display box 10, so as to help ensure connection tightness.

Figure 22:
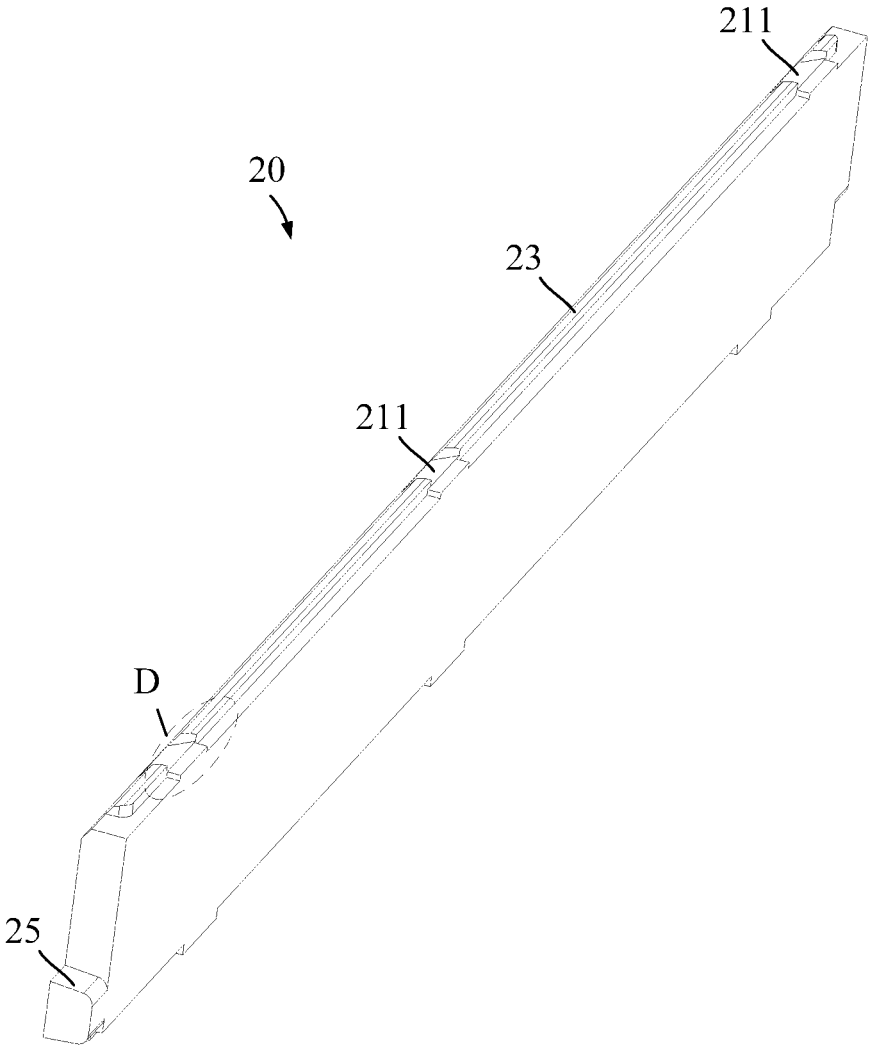
FIG. 22 is a schematic structural diagram of the thermal-insulation cover in FIG. 13 from a perspective.

Further, as shown in FIGS. 22 and 23, the anti-sinking protrusion includes a first anti-sinking protrusion 23 provided at the upper side edge of the thermal-insulation cover 20. The first anti-sinking protrusion 23 abuts on the open side edge of the upper plate 12 of the display box 10. The first anti-sinking protrusion 23 extends along the length direction of the thermal-insulation cover 20.

Figure 24:
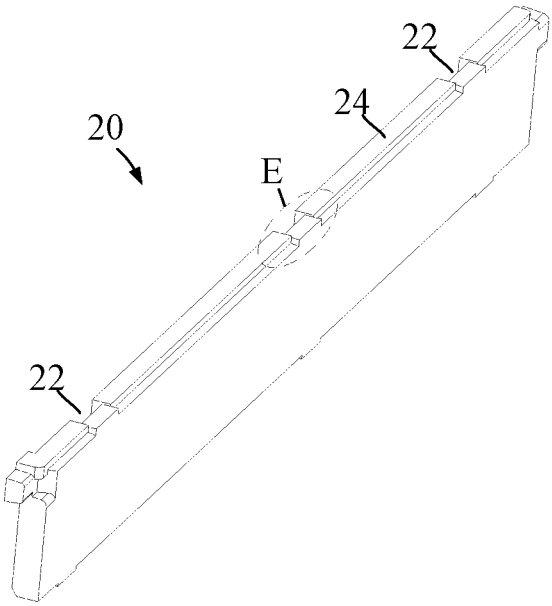
FIG. 24 is a schematic structural diagram of the thermal-insulation cover in FIG. 22 from another perspective.

As shown in FIGS. 24 and 25, the anti-sinking protrusion includes a second anti-sinking protrusion 24 provided at the upper side edge of the thermal-insulation cover 20. The second anti-sinking protrusion 24 abuts on the open side edge of the lower plate 13 of the display box 10. The second anti-sinking protrusion 24 extends along the length direction of the thermal-insulation cover 20.

As such, it is possible to ensure the tightness of the connection between the temperature insulating cover 20 and the display box 10.

Figure 10:
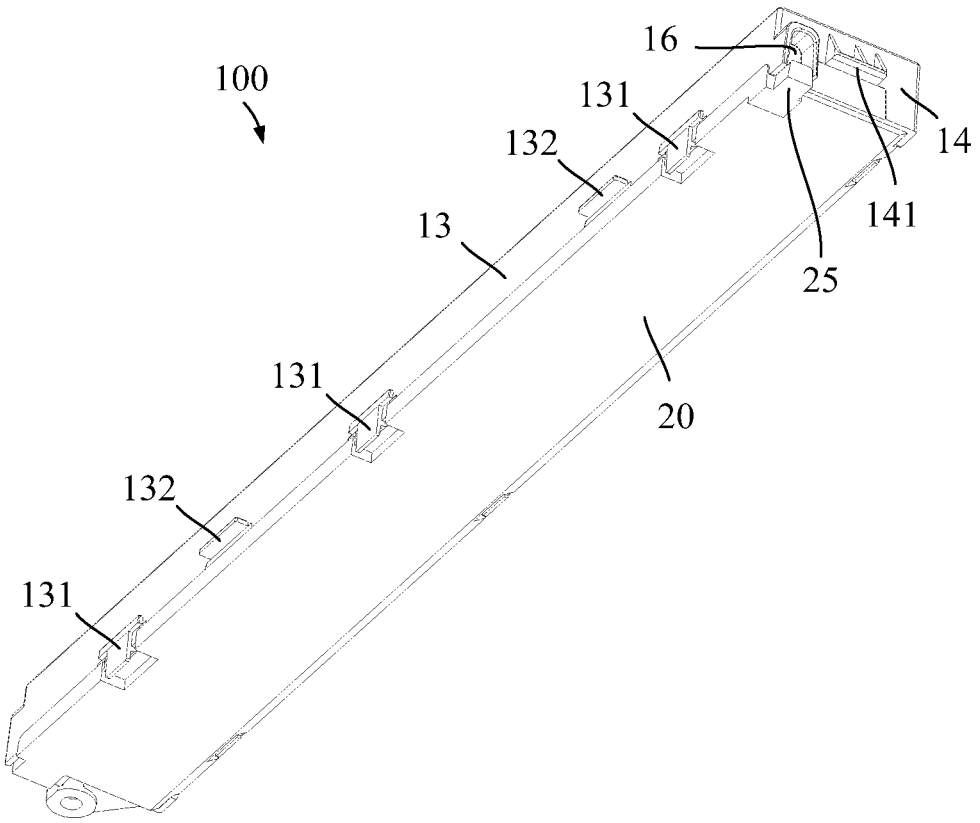
FIG. 10 is a schematic structural diagram of the display assembly in FIG. 2 from another perspective.
Figure 11:
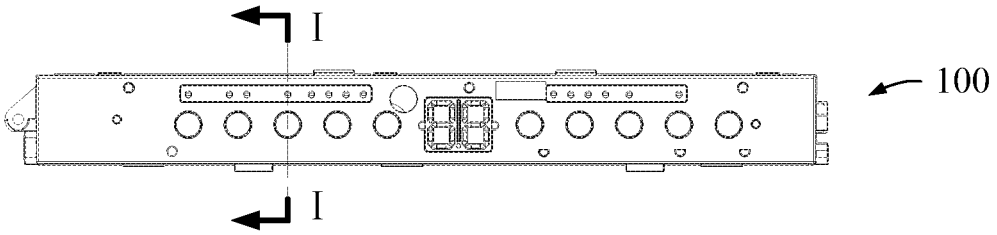
FIG. 11 is a front view of the display assembly in FIG. 9.

Further, as shown in FIG. 10, the display box 10 further includes a left plate 15 provided at the left edge of the base plate 11 and a right plate 14 provided at the right edge of the base plate 11. The open side edges of the left plate 15 protrude from the open side edges of the upper plate 12 and the lower plate 13. The open side edges of the right plate 14 protrude from the open side edges of the upper plate 12 and the lower plate 13. The left and right ends of the thermal-insulation cover 20 are respectively disposed inside the left and right plates 14 to further achieve sealing.

Further, as shown in FIGS. 9 and 10, the display box 10 is provided with a cable opening 16 that communicates with the receiving cavity, and the cable opening 16 has a cable notch communicating with the opening. The side wall of the cable opening 16 protrudes out of the display box 10 in a direction away from the display box 10, and a crimping protrusion 25 protrudes from the peripheral edge of the thermal-insulation cover 20. The crimping protrusion 25 is provided at the cable notch.

As such, the side wall of the cable opening 16 protrudes from the display box 10 in a direction away from the display box 10, such that the axial length of the cable opening 16 can be increased, so that it is convenient to improve the sealing of the display box 10, so as to prevent the generation of condensation water. Moreover, by providing the crimping protrusion 25 on the thermal-insulation cover 20, the crimping protrusion 25 can press the thread body in the cable opening 16 tightly and ensure the tightness.

In this embodiment, as shown in FIGS. 10, 14 and 16, there are two cable openings 16 and are respectively disposed at both ends of the display box 10, that is, the two cable openings 16 are respectively disposed on the left plate 15 and the right plate 14. Correspondingly, two crimping protrusions 25 are provided, and are respectively provided at both ends of the thermal-insulation cover 20.

Further, as shown in FIGS. 10, 14 and 16, the cable opening 16 is disposed near the lower plate 13. In this way, the condensate on the thread body can be prevented from flowing into the display box 10.

The present disclosure further provides a window air conditioner 1000, including:

a housing 200; and a display assembly 100 provides in the housing 200. The housing 200 has a face frame 280. The display assembly 100 is disposed in the face frame 280.

As shown in FIGS. 1-26, the specific structure of the display assembly 100 refers to the above embodiments. Since the window air conditioner 1000 of the present disclosure adopts all the technical solutions of all the above embodiments, it has at least all the advantages brought by the technical solutions of the above embodiments, which will not be repeated here.

In this embodiment, as shown in FIGS. 1, 2, 5 and 6, the window air conditioner 1000 further includes an indoor heat exchanger 300, and an upper portion of the indoor heat exchanger 300 is disposed near the thermal-insulation cover 20.

It should be pointed out here that the thermal-insulation cover 20 can be insulated, so that even if the upper portion of the indoor heat exchanger 300 is close to the thermal-insulation cover 20, the display assembly 100 can be prevented from generating condensate to improve product reliability.

Further, the display box 10 is detachably mounted at the face frame 280. In this way, the display assembly 100 can be easily tested, repaired or replaced.

Further, the display box 10 is detachably mounted at the face frame 280 through a clamping structure and/or a screw lock structure. In this way, the display box 10 and the face frame 280 can be preliminarily positioned and initially limited by the clamping structure, and then the connection strength can be improved by the screw lock structure, to ensure the stability of the connection between the display box 10 and the face frame 280, thereby improving the reliability of the product.

Further, as shown in FIGS. 1, 2 and 5-8, the face frame 280 includes a display panel 220; a connection plate 230 provided at a lower edge of the display panel 220 and extending inwards; and an air inlet panel 240 provided at an inner edge of the connection plate 230 and extending downwards. An air outlet 203 is provided above the display panel 220, an air inlet 202 is provided at the air inlet panel 240, the display assembly 100 is provided above the connection plate 230, and the display box 10 is connected to the connection plate 230 and/or the display panel 220. As such, by setting the face frame 280, an installation space (that is, a space above the connection plate 230) for installing the display assembly 100 can be formed inside the face frame 280, thereby improving the protection effect of the display assembly 100.

From the above, in this embodiment, the surrounding plate of the display box 10 includes an upper plate 12, a left plate 15, a lower plate 13 and a right plate 14 connected in sequence.

Further, as shown in FIGS. 2-4, 6 and 16, a first locking protrusion 122 is provided at the upper side of the upper plate 12, and a first elastic buckle 250 is provided protruding on the inner side of the display panel 220. The first elastic buckle 250 is disposed above the display box 10, and the first elastic buckle 250 is locked to the first locking protrusion 122. In this way, the upper side of the display box 10 can be limited.

In this embodiment, as shown in FIGS. 2-4, 6 and 16, there are a plurality of first protrusions 122 spaced apart from each other in the length direction of the upper plate 12, and correspondingly, there are also a plurality of first elastic buckles 250 to improve connection stability.

In this embodiment, optionally, the first elastic buckle 250 is a reverse buckle.

Further, as shown in FIGS. 2-4, 6 and 16, the right side of the right plate 14 is provided with a second locking protrusion 141, and the inner side of the display panel 220 is protruded with a second elastic buckle 260. The second elastic buckle 260 is disposed on the right side of the display box 10, and the second elastic buckle 260 is engaged with the second locking protrusion 141. In this way, the right side of the display box 10 can be limited.

In this embodiment, optionally, the second elastic buckle 260 is a reverse buckle.

Further, as shown in FIGS. 2-4, 6 and 14, a first blocking protrusion 132 is provided at the lower side of the lower plate 13, and a second blocking protrusion 270 is provided at the upper side of the connection plate 230. The first blocking protrusion 132 is disposed on a side of the second blocking protrusion 270 towards the display panel 220, and the first blocking protrusion 132 abuts on the second blocking protrusion 270. In this way, the lower side of the display box 10 can be limited.

Further, as shown in FIGS. 2-4, 6 and 14, a plurality of the first blocking protrusions 132 are spaced apart from each other in the length direction of the lower plate 13, and correspondingly, a plurality of the second blocking protrusions 270 are also provided to improve the connection stability.

Further, as shown in FIGS. 2-4, 6 and 9, the left plate 15 protrudes to the left with a screw connection portion 151, and the screw connection portion 151 is connected to the display panel 220 by a screw lock structure. In this way, the left side of the display box 10 can be limited.

Specially, a screw pillar opposite to the screw connection portion 151 protrudes from the inner surface of the display panel 220. The screw can pass through the screw connection portion 151 to be screw-connected with the screw pillar.

When the display assembly 100 is mounted on the face frame 280, the first blocking protrusion 132 may be inserted into the side of the second blocking protrusion 270 towards the display panel 220 first; then rotate the display box 10, and press the upper and right portions of the display box 10, respectively, to engage the first elastic buckle 250 with the first buckle 122, and the second elastic buckle 260 with the second buckle 141; finally, the screw connection portion 151 and the display panel 220 are connected by screws.

As such, through the above structural arrangement, the display box 10 and the display assembly 100 can be firmly mounted at the face frame 280.

It should be pointed out here that in this embodiment, the display panel 220 is translucent but not transparent, so the light from the indicator light 32 and the digital display light 33 can be displayed without opening holes. Thus, the display panel 220 usually only has a key mounting hole 210, and the key via hole 111 on the display box 10 corresponds to the key mounting hole 210. As can be seen from the above structure, the flexible isolation pad 40 can seal the key via hole 111 and key mounting hole 210, therefore, cold air can be effectively prevented from entering the display box to prevent the condensate from forming on the electric control board 30, which can constitute the three-layer isolation protection of the display panel 220, the base plate 11 and the flexible isolation pad 40.

Further, as shown in FIG. 1, the housing 200 is provided with a partition groove 201 which divides the window air conditioner 1000 into an indoor unit 200*a* and an outdoor unit 200*b*. The window air conditioner 1000 is installed at the window, and the partition groove 201 is used for the shielding member provided at the window to extend.

As shown in FIG. 1, the window air conditioner 1000 further includes a mounting base 400 and a sealing member 500, the mounting base 400 is movably mounted on the partition groove 201, the sealing member 500 is inserted and connected to the mounting base 400, the sealing member 500 is fixed in an interference fit with the mounting base 400 by deformation, and the sealing member 500 is driven by the mounting base 400 to switch between the storage state and the working state.

In the storage state, the sealing member 500 is stored in the partition groove 201.

In the working state, the sealing member 500 extends laterally from the partition groove 201, and is suitable for abutting on the side wall of the shielding member and/or the window.

Specially, the window air conditioner 1000 further includes a compressor (not shown), an outdoor heat exchanger (not shown), an outdoor fan (not shown) and an indoor fan (not shown) provided in the housing 200. The compressor, the outdoor heat exchanger, and the outdoor fan are provided in the outdoor unit 200*b*. The display assembly 100, the indoor heat exchanger 300, and the indoor fan are installed in the indoor unit 200*a*.

After the window air conditioner 1000 is mounted at the window of the wall, the indoor unit 200*a* is located indoors, and the outdoor unit 200*b* is located outdoors. In this way, not only the noise can be blocked and the noise reduction effect can be achieved; moreover, the shielding member provided at the window can be extended into the partition groove 201 to reduce the interference of the window air conditioner 1000 on the shielding member. It should be noted that the shielding member can block curtains, window shutters, or sashes that block light, or other protective window plates that can block external objects from entering the room.

It should be noted that in the technical solution of the present disclosure, the sealing member 500 is inserted into and connected to the mounting base 400, and the sealing member 500 is fixed in an interference fit with the mounting base 400 by deformation, such that the assembly of both the sealing member 500 and the mounting base 400 does not require components such as the screw structures or the clamping structure. The assembly process is relatively simple and the operation difficulty is low, which helps to improve assembly efficiency. The deformation may be flexible deformation or elastic deformation.

Alternatively, the sealing member 500 can be switched between the storage state and the working state by being driven by the mounting base 400. In the storage state, the sealing member 500 is stored in the partition groove 201 to fully utilize the partition groove 201 to store the sealing member 500 to reduce the overall volume of the window air conditioner 1000, which is convenient for storage or packaging and transportation. In the working state, the sealing member 500 extends laterally from the partition groove 201 for the shielding member and/or the inner wall of the window to resist, to seal the gap between the shielding member and the inner wall of the installation opening, to reduce the leakage of cold or heat to the outside and prevent the water in the outdoor environment from falling into the room from the gap, thereby greatly enhancing the sealing effect.

Besides, since the sealing member 500 can be deformed flexibly or elastically, when the shielding member is pressed down against the surface of the sealing member 500, the sealing member 500 will also deform slightly. Therefore, the seal between the sealing member 500 and the shielding member can be made tighter, it is not easy to form a gap between the sealing member 500 and the shielding member, the sealing effect is improved, and the effect of waterproofing, leakproof and cold heat is effectively enhanced.

The above are only some embodiments of the present disclosure, and thus do not limit the scope of the present disclosure. Based on the present disclosure, equivalent structural transformations made by the description and drawings of the present disclosure, or direct/indirect application in other related technical fields are included in the scope of the present disclosure.

What is claimed is:

1. A display assembly comprising:

a display box including a base plate, the base plate including a display portion and a key via hole;

an electric control board provided in the display box;

a flexible isolation pad provided in the display box, the flexible isolation pad being located between the base plate and the electric control board, and configured to isolate the base plate from the electric control board; and a control key movably provided in the key via hole, the control key being configured to abut against the flexible isolation pad, and to interact with the electric control board through the flexible isolation pad;

wherein:

an indicator light protrudes from the electric control board, a connection hole is provided at the flexible isolation pad, a connection protrusion protrudes from a side of the base plate facing the flexible isolation pad, the display portion includes a lamp mounting hole provided at the connection protrusion, the lamp mounting hole penetrates the base plate, the connection protrusion is inserted in the connection hole, and the indicator light is provided in the lamp mounting hole; and/or a digital display protrusion protrudes from the side of the base plate facing the flexible isolation pad, the display portion includes a digital display through hole provided at the digital display protrusion, the flexible isolation pad is provided with an avoiding through hole, and the digital display protrusion is provided in the avoiding through hole; and/or an alarm protrudes from the electrical control board, a first avoiding groove is provided at a side of the flexible isolation pad facing away from the base plate and corresponds to the alarm, and the alarm is provided in the first avoiding groove; and/or a remote control receiver protrudes from the electric control board, a second avoiding groove is provided at the side of the flexible isolation pad facing away from the base plate and corresponds to the remote control receiver, and the remote control receiver is provided in the second avoiding groove.

2. The display assembly of claim 1, wherein the flexible isolation pad includes a silicone pad or a soft rubber pad.

3. The display assembly of claim 1, wherein:

the flexible isolation pad is attached to a periphery of the key via hole; and/or the flexible isolation pad is at least partially attached to a periphery of the electric control board.

4. The display assembly of claim 1, wherein the control key is integrated with the flexible isolation pad.

5. The display assembly of claim 4, wherein the flexible isolation pad includes an annular movable portion outside the control key, a thickness of the annular movable portion being smaller than a thickness of the flexible isolation pad outside the annular movable portion.

6. The display assembly of claim 5, wherein:

a side of the flexible isolation pad facing away from the base plate is provided with a first sink groove corresponding to the control key; and/or a side of the flexible isolation pad facing the base plate is provided with a second sink groove, the control key being provided at a bottom of the second sink groove.

7. The display assembly of claim 6, wherein:

a key groove is provided at a bottom of the first sink groove, a button of a key switch on the electric control board being provided in the key groove; and an annular groove is provided at a bottom of the key groove, the annular groove being provided at a periphery of the control key.

8. The display assembly of claim 1, wherein the electric control board is connected with the base plate through a screw lock structure.

9. The display assembly of claim 1, further comprising:

a thermal-insulation cover;

wherein:

the display box further includes a surrounding plate provided at a periphery of the base plate, an opening being formed at an end of the surrounding plate away from the base plate; and the thermal-insulation cover is arranged at the opening.

10. The display assembly of claim 9, wherein the thermal-insulation cover is detachably provided at the opening, and is configured to open or cover the opening.

11. The display assembly of claim 10, wherein the thermal-insulation cover is connected with the display box through a clamping structure, and is detachably provided at the opening through the clamping structure.

12. The display assembly of claim 11, wherein the surrounding plate includes a plurality of elastic limiters protruding from a periphery of the opening and spaced apart from each other, and the thermal-insulation cover is clamped between the elastic limiters.

13. The display assembly of claim 12, wherein:

one of the elastic limiters includes an elastic pressing plate, a side surface of the elastic pressing plate facing the thermal-insulation cover including a pressing surface inclined towards an inner side of the opening; and a side surface of the thermal-insulation cover facing away from the electric control board includes a limiting surface cooperating with the pressing surface.

14. The display assembly of claim 13, wherein one of the elastic limiters includes an elastic pressing buckle, a side of the elastic pressing buckle facing the thermal-insulation cover including a clamping protrusion clamped at a side of the thermal-insulation cover facing away from the electric control board.

15. The display assembly of claim 14, wherein:

the surrounding plate includes an upper plate provided at an upper edge of the base plate and a lower plate provided at a lower edge of the base plate;

the elastic pressing plate is one of a plurality of elastic pressing plates provided at a side edge of an opening of the upper plate, the plurality of elastic pressing plates being spaced apart from each other in a length direction of the upper plate; and/or the elastic pressing buckle is one of a plurality of elastic pressing buckles provided at a side edge of an opening of the lower plate, the plurality of elastic pressing buckle being spaced apart from each other in a length direction of the lower plate.

16. The display assembly of claim 12, wherein the thermal-insulation cover is provided in the opening and includes an anti-sinking protrusion at a periphery of the thermal-insulation cover, the anti-sinking protrusion being configured to abut on the periphery of the opening.

17. The display assembly of claim 9, wherein the thermal-insulation cover includes a foam piece.

18. A window air conditioner comprising:

a housing including a face frame; and a display assembly provided in the housing and at the face frame, the display assembly including:

a display box including a base plate provided at the face frame, the base plate including a display portion and a key via hole;

an electric control board provided in the display box;

a flexible isolation pad provided in the display box, the flexible isolation pad being located between the base plate and the electric control board, and configured to isolate the base plate from the electric control board; and a control key movably provided in the key via hole, the control key being configured to abut against the flexible isolation pad, and to interact with the electric control board through the flexible isolation pad;

wherein:

an indicator light protrudes from the electric control board, a connection hole is provided at the flexible isolation pad, a connection protrusion protrudes from a side of the base plate facing the flexible isolation pad, the display portion includes a lamp mounting hole provided at the connection protrusion, the lamp mounting hole penetrates the base plate, the connection protrusion is inserted in the connection hole, and the indicator light is provided in the lamp mounting hole; and/or a digital display protrusion protrudes from the side of the base plate facing the flexible isolation pad, the display portion includes a digital display through hole provided at the digital display protrusion, the flexible isolation pad is provided with an avoiding through hole, and the digital display protrusion is provided in the avoiding through hole; and/or an alarm protrudes from the electrical control board, a first avoiding groove is provided at a side of the flexible isolation pad facing away from the base plate and corresponds to the alarm, and the alarm is provided in the first avoiding groove; and/or a remote control receiver protrudes from the electric control board, a second avoiding groove is provided at the side of the flexible isolation pad facing away from the base plate and corresponds to the remote control receiver, and the remote control receiver is provided in the second avoiding groove.

19. The window air conditioner of claim 18, wherein:

the face frame includes:

a display panel, an air outlet being provided above the display panel;

a connection plate provided at a lower edge of the display panel and extending inwards; and an air inlet panel provided at an inner edge of the connection plate and extending downwards, an air inlet being provided at the air inlet panel;

the display assembly is provided above the connection plate; and the display box is connected to at least one of the connection plate or the display panel.

* * * * *